US009405223B2

(12) United States Patent
Oshikawa et al.

(10) Patent No.: US 9,405,223 B2
(45) Date of Patent: Aug. 2, 2016

(54) DEVELOPING DEVICE, IMAGE FORMING APPARATUS, AND PROCESS CARTRIDGE

(71) Applicants: Yuki Oshikawa, Ayase (JP); Noriyuki Kimura, Kawasaki (JP); Kenji Kikuchi, Yokohama (JP); Yoshihiro Fujiwara, Yokohama (JP); Shuntaroh Tamaki, Yokohama (JP)

(72) Inventors: Yuki Oshikawa, Ayase (JP); Noriyuki Kimura, Kawasaki (JP); Kenji Kikuchi, Yokohama (JP); Yoshihiro Fujiwara, Yokohama (JP); Shuntaroh Tamaki, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/732,161

(22) Filed: Jun. 5, 2015

(65) Prior Publication Data

US 2015/0362861 A1 Dec. 17, 2015

(30) Foreign Application Priority Data

Jun. 12, 2014 (JP) ..... 2014-121163

(51) Int. Cl.
*G03G 15/08* (2006.01)

(52) U.S. Cl.
CPC ..... *G03G 15/0865* (2013.01); *G03G 15/0882* (2013.01); *G03G 15/0893* (2013.01)

(58) Field of Classification Search
None
See application file for complete search history.

(56) References Cited

U.S. PATENT DOCUMENTS

| | | | | |
|---|---|---|---|---|
| 4,998,140 | A * | 3/1991 | Satou | G03G 15/0882 399/105 |
| 7,099,609 | B2 | 8/2006 | Hirobe et al. | |
| 7,428,393 | B2 | 9/2008 | Hosokawa et al. | |
| 7,835,671 | B2 | 11/2010 | Suzuki | |
| 8,326,180 | B2 | 12/2012 | Fujiwara et al. | |
| 8,326,184 | B2 | 12/2012 | Kudo et al. | |
| 8,433,224 | B2 | 4/2013 | Fujiwara et al. | |
| 8,489,001 | B2 | 7/2013 | Kimura | |
| 8,571,449 | B2 | 10/2013 | Miyoshi et al. | |
| 8,649,714 | B2 | 2/2014 | Kudo et al. | |
| 8,750,752 | B2 | 6/2014 | Miyoshi et al. | |
| 8,843,015 | B2 | 9/2014 | Utsunomiya et al. | |

(Continued)

FOREIGN PATENT DOCUMENTS

| | | |
|---|---|---|
| JP | H05-333691 | 12/1993 |
| JP | 2003-323043 | 11/2003 |

(Continued)

*Primary Examiner* — Clayton E Laballe
*Assistant Examiner* — Jas Sanghera
(74) *Attorney, Agent, or Firm* — Oblon, McClelland, Maier & Neustadt, L.L.P.

(57) ABSTRACT

A developing device includes a developer bearer to carry developer to a developer range where the developer bearer faces a latent image bearer, a development casing forming a developer storing part storing the developer to supply to the surface of developer bearer, a developer through opening communicating a space in where the developer bearer is disposed and the developer storing part, a cover sheet covering the developer through opening at the developing casing, and when the cover sheet is removed, the developer pass through the developer through opening, a sheet collecting shaft to collect the cover sheet by rotating, and a transmitting mechanism to transmit a force for rotating to the sheet collecting shaft. The transmitting mechanism does not transmit the force to the collecting shaft after the cover sheet is collected.

18 Claims, 11 Drawing Sheets

(56) References Cited

U.S. PATENT DOCUMENTS

| | | | | |
|---|---|---|---|---|
| 8,855,536 | B2 | 10/2014 | Kimura et al. | |
| 8,873,979 | B2 | 10/2014 | Fujiwara et al. | |
| 8,909,095 | B2 | 12/2014 | Yamane et al. | |
| 8,923,726 | B2 | 12/2014 | Tsuda et al. | |
| 2001/0033756 | A1* | 10/2001 | Shiratori ..... | G03G 21/1857 399/103 |
| 2013/0034368 | A1* | 2/2013 | Hattori ..... | G03G 15/0881 399/106 |
| 2014/0169827 | A1 | 6/2014 | Hattori et al. | |
| 2014/0233984 | A1 | 8/2014 | Miyoshi et al. | |
| 2014/0270838 | A1 | 9/2014 | Yoshizawa et al. | |

FOREIGN PATENT DOCUMENTS

| | | |
|---|---|---|
| JP | 2005-189423 | 7/2005 |
| JP | 2008-26408 | 2/2008 |
| JP | 2011-191666 | 3/2011 |
| JP | 2011-174954 | 9/2011 |

* cited by examiner

DEVELOPING DEVICE, IMAGE FORMING APPARATUS, AND PROCESS CARTRIDGE

CROSS-REFERENCE TO RELATED APPLICATION

This patent application is based on and claims priority pursuant to 35 U.S.C. §119(a) to Japanese Patent Application No. 2014-121163, filed on Jun. 12, 2014, in the Japan Patent Office, the entire disclosure of which is hereby incorporated by reference herein.

BACKGROUND

1. Technical Field

Embodiments of the present disclosure generally relate to a developing device, a process cartridge, and an image forming apparatus, such as a copier, a printer, a facsimile machine, or a multifunction machine having at least two of coping, printing, facsimile transmission, plotting, and scanning capabilities, that includes a developing device.

2. Description of the Background Art

New developer stored in the developing device needs to be separate from the developing bearer in time to shipping or carrying.

If the new developer is kept contacting to a surface of the developing bearer for a long time, the new developer gets stuck on the developing bearer.

SUMMARY

So, the cover sheet to separate a developing storing part and the developing bearer is needed to be disposed between the developing storing part and the developing bearer. And after the cover sheet is disposed, the new developer is filled to the developer storing part. Then the developer will be shipped.

After a user or service-man receives the developing unit or image forming apparatus with developing device, they will remove the cover sheet and start to use the developing unit or image forming apparatus.

A developing device including a developing roller, development casing to store a developer, an opening communicating with a space in where the developing roller is disposed and a developer storing part, a cover sheet covering the opening, and a sheet collecting shaft collecting the cover sheet with rotating before using, is provided.

A transmitting mechanism to transmit a force for rotating to the sheet collecting shaft is also provided.

The transmitting mechanism does not transmit the force to the collecting shaft after the cover sheet is collected.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1A:
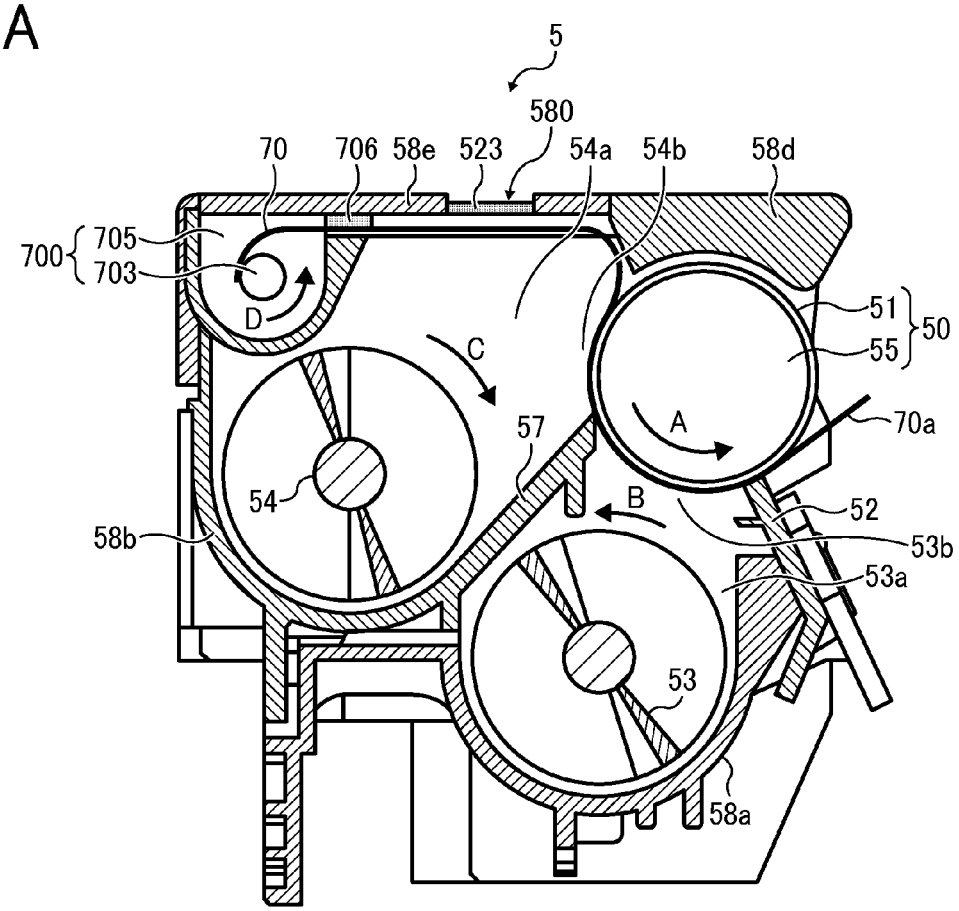
FIG. 1A is a cross sectional view of a developing device before used.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Figure 2:
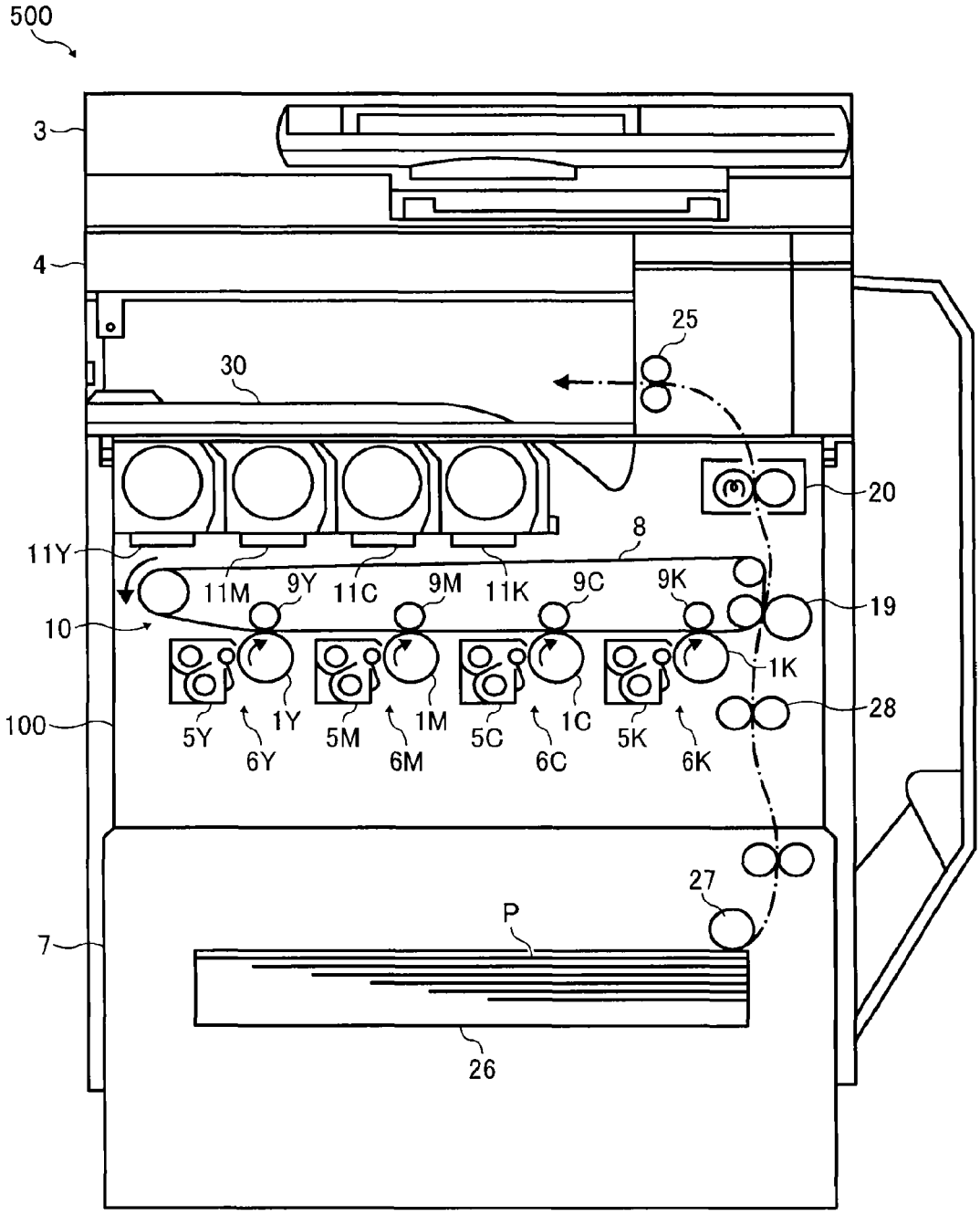
FIG. 2 is view of an image forming apparatus.

FIG. 2 is a schematic diagram that illustrates a configuration of an image forming apparatus 500 according to the present embodiment, which can be a tandem-type multicolor copier, for example.

The image forming apparatus 500 includes a printer unit 100 that is an apparatus body, a document reading unit 4 and a document feeder 3, both disposed above the printer unit 100, and a sheet feeding unit 7 disposed beneath the printer unit 100. The document feeder 3 feeds originals to the document reading unit 4, and the document reading unit 4 reads image data of the originals. The sheet feeding unit 7 is a sheet container that contains sheets P (transfer sheets) of recording media and includes a sheet tray 26 in which the sheets P are stored and a feed roller 27 to feed the sheets P from the sheet tray 26 to the printer unit 100. It is to be noted that broken lines shown in FIG. 2 represent a conveyance path through which the sheet P is transported inside the image forming apparatus 500.

A discharge tray 30 on which output images are stacked is provided on an upper side of the printer unit 100. The printer unit 100 includes four image forming units 6Y, 6M, 6C, and 6K for forming yellow, magenta, cyan, and black toner images, respectively, and an intermediate transfer unit 10. Each image forming unit 6 includes a drum-shaped photoreceptor 1 serving as an image bearer on which a toner image is formed, and a developing device 5 for developing an electrostatic latent image formed on the photoreceptor 1 into the toner image.

The intermediate transfer unit 10 includes four primary-transfer bias rollers 9Y, 9M, 9C, and 9K in addition to an intermediate transfer belt 8. The intermediate transfer belt 8 serves as an intermediate transfer member onto which the toner images are transferred from the respective photoreceptors 1, and the toner images are superimposed one on another thereon, thus forming a multicolor toner image. The primary-transfer bias rollers 9 serve as primary-transfer members to primarily transfer the toner images formed on the photoreceptors 1 onto the intermediate transfer belt 8.

The printer unit 100 further includes a secondary-transfer bias roller 19 to transfer the multicolor toner image from the intermediate transfer belt 8 onto the sheet P. Further, a pair of registration rollers 28 is provided to suspend the transport of the sheet P and adjust the timing to transport the sheet P to a secondary-transfer nip between the intermediate transfer belt 8 and the secondary-transfer bias roller 19 pressed against it. The printer unit 100 further includes a fixing device 20 disposed above the secondary-transfer nip to fix the toner image on the sheet P.

Additionally, toner containers 11Y, 11M, 11C, and 11K for containing respective color toners supplied to the developing devices 5 are provided inside the printer unit 100, beneath the discharge tray 30 and above the intermediate transfer unit 10.

Figure 3:
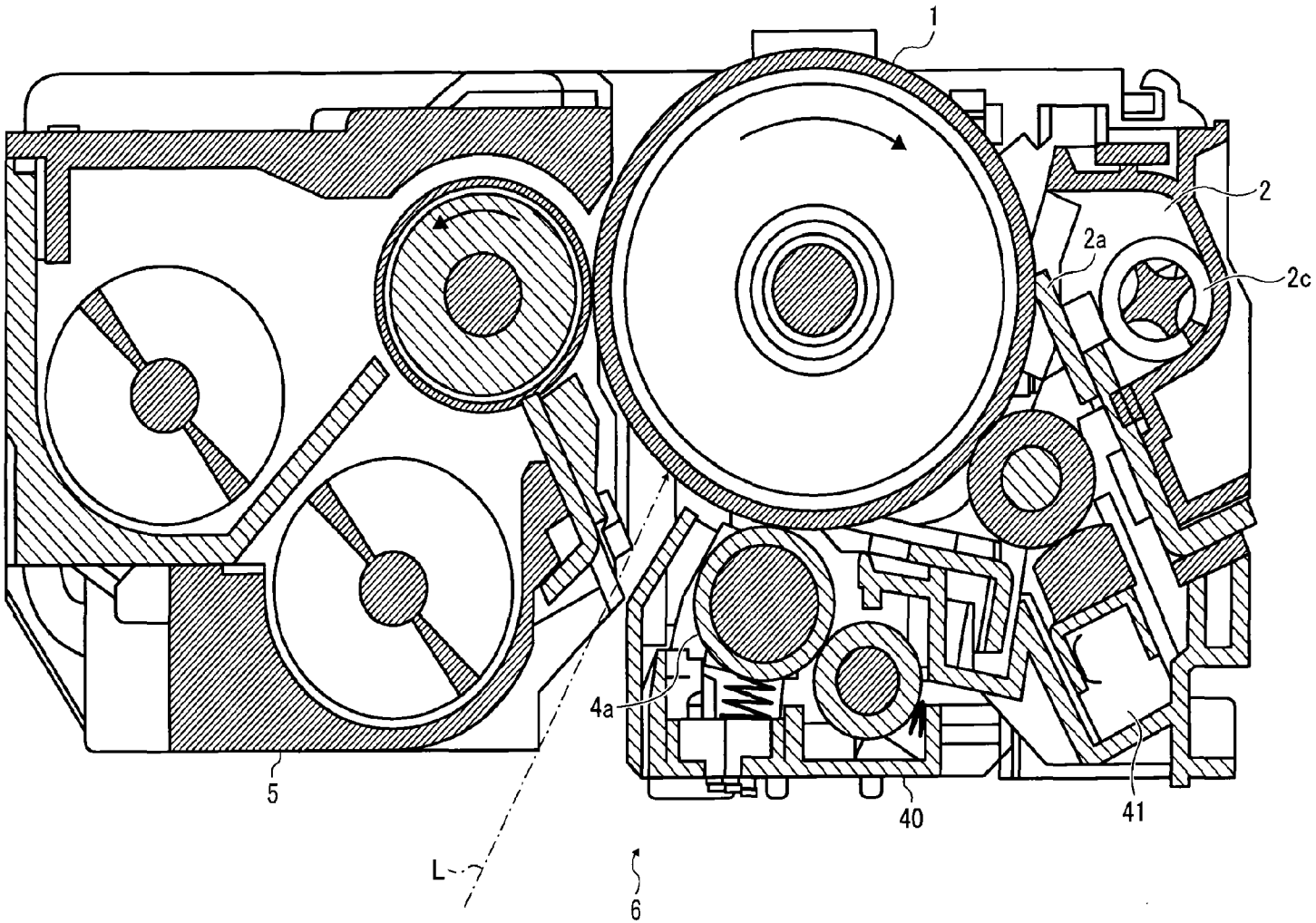
FIG. 3 is view of a developing part.

FIG. 3 is an enlarged view of one of the four image forming units 6. The four image forming units 6 have a similar configuration except the color of toner used therein, and hereinafter the suffixes Y, M, C, and K may be omitted when color discrimination is not necessary.

As shown in FIG. 3, the image forming unit 6 includes a common unit casing to support the photoreceptor 1 and the developing device 5 and is configured as a modular unit (i.e., a process cartridge) removably installable in the apparatus body of the image forming apparatus 500. This configuration can facilitate replacement of the developing device 5 in the apparatus body, thus facilitating maintenance work.

Additionally, the image forming unit 6 includes a cleaning unit 2, a charging device 40, and a lubrication device 41 positioned around the photoreceptor 1 in addition to the developing device 5. In the image forming unit 6 according to the present embodiment, the cleaning unit 2 employs a cleaning blade 2*a*, and the charging device 40 employs a charging roller 4*a*.

Operations of the image forming apparatus 500 shown in FIG. 2 to form multicolor images are described below.

When users press a start button with originals set on a document table of the document feeder 3, conveyance rollers provided in the document feeder 3 transport the originals from the document table onto an exposure glass (contact glass) of the document reading unit 4. Then, the document reading unit 4 reads image data of the original set on the exposure glass optically.

More specifically, the document reading unit 4 scans the image of the original with light emitted from an illumination lamp. The light reflected from the surface of the original is imaged on a color sensor via mirrors and lenses. The color sensor reads the multicolor image data of the original for each of decomposed colors of red, green, and blue (RGB), and converts the image data into electrical image signals. Further, the image signals are transmitted to an image processor that performs image processing (e.g., color conversion, color calibration, and spatial frequency adjustment) according to the image signals, and thus image data of yellow, magenta, cyan, and black are obtained.

Then, the image data of yellow, magenta, cyan, and black are transmitted to a writing unit (i.e., an exposure device). Then, the exposure device directs laser beams L to the respective photoreceptors 1 according to image data of respective colors.

Meanwhile, the four photoreceptors 1 rotate clockwise in FIGS. 2 and 3. The surface of the photoreceptor 1 is charged uniformly at a position facing the charging roller 4*a* of the charging device 40 (a charging process). Thus, charge potentials are given to the surface of each photoreceptor 1. Subsequently, the surface of the photoreceptor 1 thus charged reaches a position to receive the laser beam L.

Then, the laser beams L according to the respective color image data are emitted from four light sources of the exposure device. The laser beams pass through different optical paths for yellow, magenta, cyan, and black and reach the surfaces of the respective photoreceptors 1 (an exposure process).

The laser beam L corresponding to the yellow component is directed to the photoreceptor 1Y that is the first from the left in FIG. 2 among the four photoreceptors 1. A polygon mirror that rotates at high velocity deflects the laser beam L for yellow in a direction of a rotation axis of the photoreceptor 1Y (main scanning direction) so that the laser beam L scans the surface of the photoreceptor drum 1Y. With the scanning of the laser beam L, an electrostatic latent image for yellow is formed on the photoreceptor 1Y charged by the charging device 40.

Similarly, the laser beam L corresponding to the magenta component is directed to the surface of the photoreceptor 1M that is the second from the left in FIG. 2, thus forming an electrostatic latent image for magenta thereon. The laser beam L corresponding to the cyan component is directed to the surface of the photoreceptor 1C that is the third from the left in FIG. 2, thus forming an electrostatic latent image for cyan thereon. The laser beam L corresponding to the black component is directed to the surface of the photoreceptor 1K that is the fourth from the left in FIG. 2, thus forming an electrostatic latent image for black thereon.

Subsequently, the surface of the photoreceptor 1 where the electrostatic latent image is formed is further transported to the position facing the developing device 5. The developing device 5 contains developer including toner (toner particles) and carrier (carrier particles) and supplies toner to the surface of the photoreceptor 1, developing the latent image thereon (a development process) into a single-color toner image.

Then, the surfaces of the respective photoreceptors 1 reach positions facing the intermediate transfer belt 8, where the respective primary-transfer bias rollers 9 are provided in contact with an inner circumferential surface of the intermediate transfer belt 8 The primary-transfer bias rollers 9 face the respective photoreceptors 1 via the intermediate transfer belt 8, thus forming primary-transfer nips, where the single-color toner images are transferred from the respective photoreceptors 1 and superimposed one on another on the intermediate transfer belt 8 (a transfer process).

Subsequently, the surface of the photoreceptor 1 reaches a position facing the cleaning unit 2, where the cleaning blade 2*a* scrapes off toner remaining on the photoreceptor 1 (a cleaning process).

Additionally, the surface of each photoreceptor 1 passes through a discharge section facing a discharger, and electrical potentials remaining on the surface of the photoreceptor 1 are removed. Thus, a sequence of image forming processes performed on each photoreceptor 1 is completed, and the photoreceptor 1 is prepared for subsequent image formation.

Meanwhile, the intermediate transfer belt 8 carrying the superimposed single-color toner images (a multicolor toner image) transferred from the four photoreceptors 1 rotates counterclockwise in FIG. 2 and reaches a position facing the secondary-transfer bias roller 19.

Additionally, the feed roller 27 sends out the sheet P from the sheet tray 26, and the sheet P is then guided by a sheet guide to the registration rollers 28. The sheet P is caught in the nip between the registration rollers 28 and stopped. Then, the registration rollers 28 forward the sheet P to the secondary-transfer nip, timed to coincide with the multicolor toner on the intermediate transfer belt 8.

In the secondary-transfer nip, the multicolor toner image is transferred from the intermediate transfer belt 8 onto the sheet P (a secondary-transfer process).

Subsequently, the intermediate transfer belt 8 reaches a position facing the belt cleaning unit including a belt cleaning blade, where toner remaining on the intermediate transfer belt 8 is collected by the belt cleaning unit. Thus, a sequence of transfer processes performed on the intermediate transfer belt 8 is completed.

The sheet P carrying the multicolor toner image is sent to the fixing device 20. In the fixing device 20, a fixing belt and a pressing roller are pressed against each other, forming a fixing nip, where the toner image is fixed on the sheet P with heat and pressure (i.e., a fixing process).

Then, the sheet P is transported by a pair of discharge rollers 25 and discharged outside the printer unit 100 as an output image onto the discharge tray 30. Thus, a sequence of image forming processes is completed.

Figure 4:
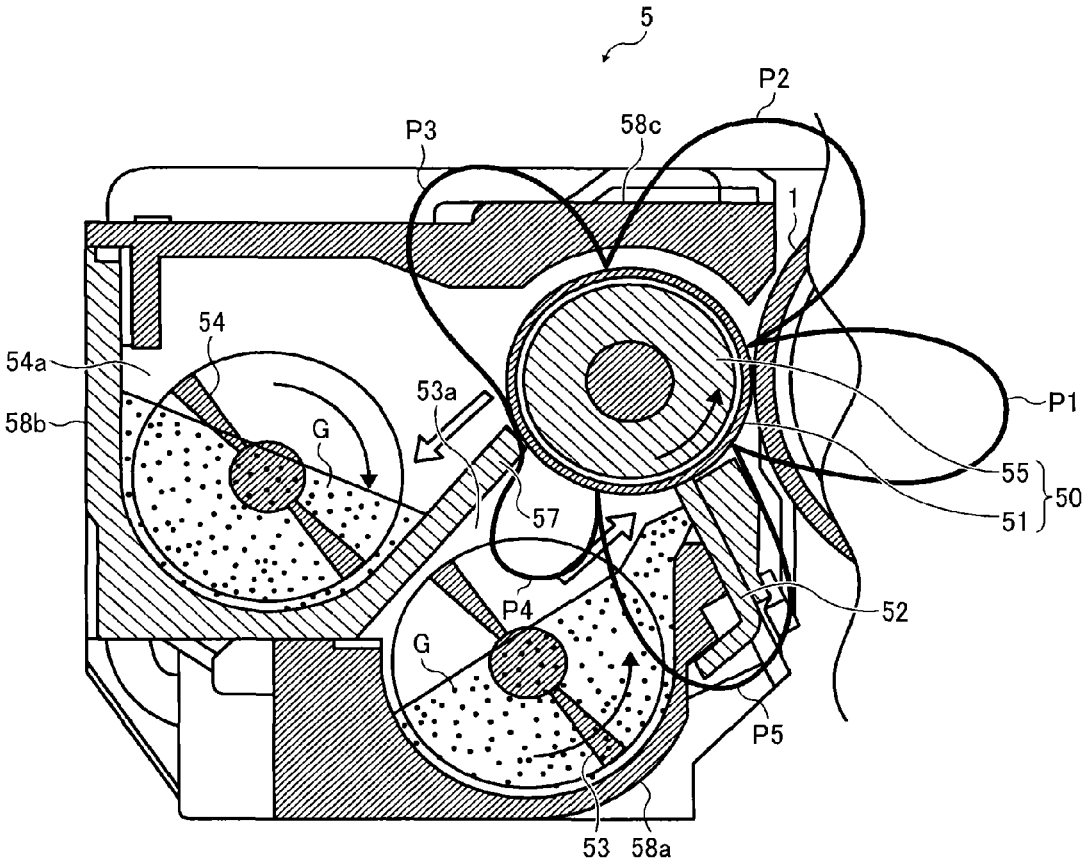
FIG. 4 is a cross sectional view of the developing device.

FIG. 4 is a cross-sectional view of the developing device 5 according to the present embodiment. The developing device 5 includes a casing 58 to contain developer. The casing 58 includes a lower case 58*a*, an upper case 58*b*, and a development cover 58*c*.

The developing device 5 includes a developing roller 50 serving as a developer bearer disposed facing the photoreceptor 1, multiple developer conveyance members, namely, a supply screw 53 and a collecting screw 54, a doctor blade 52 serving as a developer regulator, and a partition 57. The supply screw 53 and the collecting screw 54 may be screw members each including a rotary shaft and a spiral blade winding around the rotary shaft and transport developer in an axial direction by rotating.

The partition 57 divides, at least partly, an interior of the casing 58 into a supply channel 53*a* in which the supply screw 53 is provided and a collecting channel 54*a* in which the collecting screw 54 is provided. Additionally, on the cross section (shown in FIG. 4) perpendicular to the axial direction, an end face of the partition 57 faces the developing roller 50 and positioned adjacent to the developing roller 50. Thus, the partition 57 can also serve as a separator to facilitate separation of developer from the surface of the developing roller 50. The partition 57 having the separating capability can inhibit the developer that has passed through the development range, carried on the developing roller 50, from reaching the supply channel 53*a*. Thus, the developer is not retained but can move to the collecting channel 54*a*.

The developing roller 50 includes a magnet roller 55 including multiple stationary magnets and a developing sleeve 51 that rotates around the magnet roller 55. The developing sleeve 51 is a rotatable, cylindrical member constructed of a nonmagnetic material. The magnet roller 55 is housed inside the developing sleeve 51. The magnet roller 55 generates, for example, five magnetic poles, first through fifth poles P1 through P5. The first and third poles P1 and P3 are south (S) poles, and the second, fourth, and fifth poles P2, P4, and P5 are north (N) poles, for example. It is to be noted that bold petal-like lines with reference characters P1 through P5 in FIG. 4 represent density distribution (absolute value) of magnetic flux generated by the respective magnetic poles on the developing sleeve 51 in a direction normal to the surface of the developing sleeve 51.

The developing device 5 contains two-component developer consisting essentially of toner and carrier (one or more additives may be included). The supply screw 53 and the collecting screw 54 transport developer in the longitudinal direction (axial direction of the developing sleeve 51), and thus a developer circulation path is established inside the developing device 5. Additionally, the supply screw 53 and the collecting screw 54 are arranged vertically, and the supply channel 53*a* and the collecting channel 54*a* are divided from each other with the partition 57 disposed between the two developer conveyance members.

Additionally, the doctor blade 52 is provided beneath the developing roller 50 in FIG. 4 and upstream in the direction of rotation of the developing sleeve 51 from the development range where the developing roller 50 faces the photoreceptor 1. The doctor blade 52 adjusts the amount of developer conveyed to the development range, carried on the developing sleeve 51.

Further, a toner supply inlet 59 is in the developing device 5 to supply toner to the developing device 5 in response to consumption of toner because two-component developer is used in the present embodiment. While being transported, the supplied toner is agitated and mixed with the developer exiting in the developing device 5 by the collecting screw 54 and the supply screw 53.

While being transported, the supplied toner is agitated and mixed with the developer exiting in the developing device 5 by the collecting screw 54 and the supply screw 53. The developer thus agitated is partly supplied to the surface of the developing sleeve 51 serving as the developer bearer and carried thereon. After the doctor blade 52 disposed beneath the developing sleeve 51 adjusts the amount of the developer, the developer is transported to the development range. In the development range, toner in the developer on the developing sleeve 51 adheres to the latent image formed on the surface of the photoreceptor 1.

The magnet roller 55 provided with the multiple stationary magnets is inside the developing sleeve 51, and the magnet roller 55 has the multiple magnetic poles P1 through P5 for generating magnetic fields around the developing sleeve 51.

For example, the developing device 5 according to the present embodiment is filled with 300 g of developer in which toner particles, including polyester resin as a main ingredient, and magnetic carrier particles are mixed uniformly so that the concentration of toner in developer is about 7% by weight. The toner has an average particle diameter of about 5.8 μm, and the magnetic carrier has an average particle diameter of about 35 μm. The supply screw 53 and the collecting screw 54 arranged in parallel are rotated at a velocity of about 600 revolutions per minute (rpm), thereby transporting the developer while mixing toner and carrier and charging the toner.

Additionally, toner supplied through the toner supply inlet 59 is agitated in the developer by rotating the supply screw 53 and the collecting screw 54 to make the content of toner in the developer uniform.

While being transported in the longitudinal direction by the supply screw 53 positioned adjacent to and parallel to the developing sleeve 51, the developer in which toner and carrier are mixed uniformly is attracted by the fifth pole P5 of the magnet roller 55 inside the developing sleeve 51 and carried on the outer circumferential surface of the developing sleeve 51. The developer carried on the developing sleeve 51 is transported to the development range as the developing sleeve 51 rotates counterclockwise as indicated by an arrow shown in FIG. 4.

The developing sleeve 51 receives voltage from a high-voltage power source, and thus a development field (electrical field) is generated between the developing sleeve 51 and the photoreceptor 1 in the development range. With the development field, toner in developer carried on the surface of the developing sleeve 51 is supplied to the latent image formed on the surface of the photoreceptor 1, developing it.

The developer on the developing sleeve 51 that has passed through the development range is collected in the collecting channel 54*a* as the developing sleeve 51 rotates. Specifically, the developer falls from the developing sleeve 51 to an upper face of the partition 57, slides down the partition 57, and then is collected by the collecting screw 54.

Figure 6:
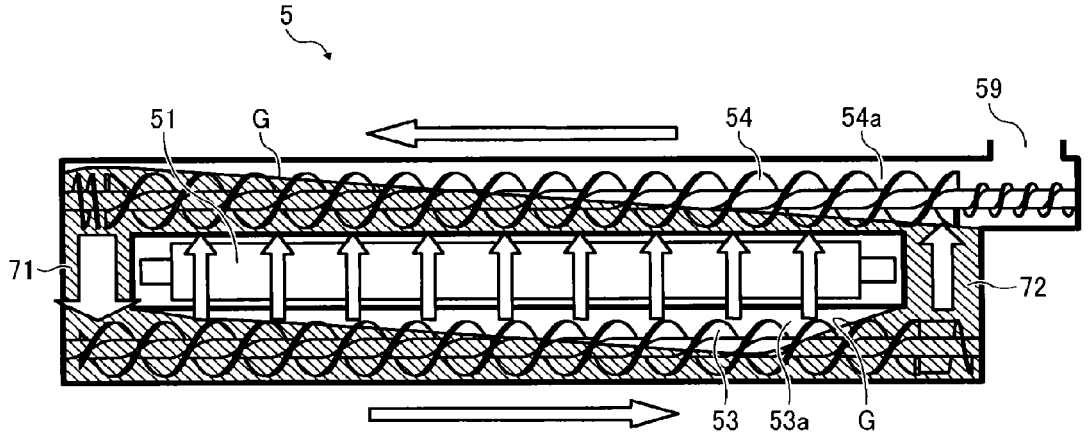
FIG. 6 is a developer movement in the developing device.

FIG. 6 is a schematic diagram illustrating movement of developer in the longitudinal direction (axial direction) inside the developing device 5. In FIG. 6, outlined arrows indicate the flow of developer in the developing device 5. Although the partition 57 is not shown in FIG. 6 for simplicity, openings (a developer-falling opening 71 and a developer-lifting opening 72) are in end portions of the partition 57 in the longitudinal direction of the developing device 5, thus forming communication portions between the supply channel 53*a* and the collecting channel 54*a*.

As shown in FIG. 6, at the downstream end of the supply channel 53*a* in the direction in which the developer is transported (hereinafter "developer conveyance direction") by the supply screw 53, developer is transported up through the developer-lifting opening 72 in the partition 57 to the upstream end the collecting channel 54*a* in the developer conveyance direction therein. By contrast, at the downstream end of the collecting channel 54*a* in the developer conveyance direction by the collecting screw 54, developer is transported through the developer-falling opening 71 in the partition 57 to the upstream end of the supply channel 53*a* in the developer conveyance direction therein.

It is to be noted that, although the supply channel 53*a* and the collecting channel 54*a* are illustrated as if they are away from each other in FIG. 6, it is intended for ease of understanding of supply and collection of developer from the developing sleeve 51. The supply channel 53*a* and the collecting channel 54*a* are separated by the planar partition 57 as shown in FIG. 4, and the developer-falling opening 71 and the developer-lifting opening 72 are through holes in the partition 57.

As shown in FIG. 6, developer inside the supply channel 53*a* beneath the collecting channel 54*a* is scooped by the surface of the supply screw 53 while being transported in the longitudinal direction by the supply screw 53. At that time, developer can be scooped by the surface of the developing sleeve 51 by the rotation of the supply screw 53 as well as the magnetic force exerted by the fifth pole P5 (shown in FIG. 4), serving as a developer scooping pole. Then, the developer carried on the developing sleeve 51 passes through the development range, is separated from the developing sleeve 51, and transported to the collecting channel 54*a*. At that time, developer is separated from the surface of the developing sleeve 51 by the magnetic force exerted by a developer release pole constructed of the fourth and fifth magnetic poles P4 and P5 having the same polarity (N) and being adjacent to each other and the separating capability of the partition 57.

In the developing device 5, the fourth and fifth poles P4 and P5 (i.e., the developer release pole) generate a repulsive magnetic force. The developer transported to the area in which the repulsive magnetic force is generated (i.e., a developer release area) is released by the developer release pole in a direction of composite of a normal direction and a direction tangential to the rotation of the developing sleeve 51. Then, the developer falls under the gravity to the partition 57 and is collected by the collecting screw 54.

The collecting screw 54 in the collecting channel 54*a*, which is above the supply channel 53*a*, transports the developer separated from the developing sleeve 51 in the developer release area axially in the direction opposite the direction in which the supply screw 53 transports the developer.

Through the developer-lifting opening 72, the downstream end of the supply channel 53*a* in which the supply screw 53 is provided communicates with the upstream end of the collecting channel 54*a* in which the collecting screw 54 is provided. The developer at the downstream end of the supply channel 53 accumulates there and pushed up by the developer transported from behind. Then, the developer moves through the developer-lifting opening 72 to the upstream end of the collecting channel 54*a*.

The toner supply inlet 59 is in the upstream end portion of the collecting channel 54*a*, and fresh toner is supplied as required by a toner replenishing device from the toner container 11 (shown in FIG. 2) to the developing device 5 through the toner supply inlet 59. The upstream end of the supply channel 53*a* communicates with the downstream end of the collecting channel 54*a* via the developer-falling opening 71. The developer transported to the downstream end of the collecting channel 54*a* falls under its own weight through the developer-falling opening 71 to the upstream end portion of the supply channel 53*a*.

The developer is supplied to the developing roller from the supply channel and the developer passed developing area is collected to the collecting channel in the developing device 5 divided the supply channel 53*a* and the collecting channel 54*a*.

In this system, the developer supplied to the developing roller does not return to the supply channel, and the developer is collected to the collecting channel. The developing device having this system is called 'one way circulation developing device'.

As described above, the supply screw 53 and the collecting screw 54 rotate in the directions shown in FIG. 4, and developer is attracted to the developing sleeve 51 by the magnetic attraction exerted by the magnet roller 55 contained in the developing sleeve 51. Additionally, the developing sleeve 51 is rotated at a predetermined velocity ratio to the velocity of the photoreceptor 1 to scoop up the developer to the development range consecutively.

Figure 1B:
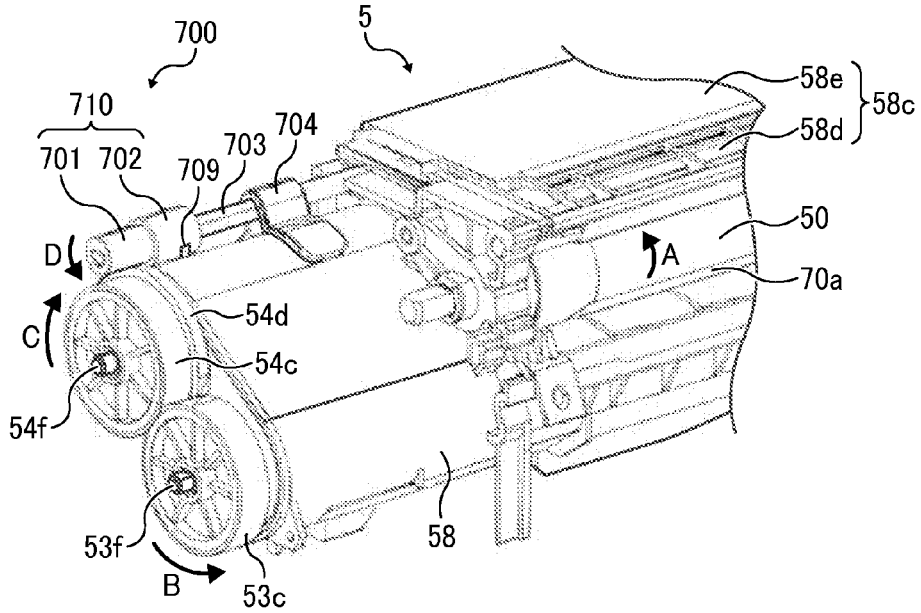
FIG. 1B is an enlarged perspective view of a developing device.

FIGS. 1A and 1B show the developing device before used by user served as new-developing device. FIG. 1A is a cross-sectional view of the developing device 5, and FIG. 1B is an enlarged perspective view of the developing device of the end side of axis direction. The developer is stored in the supply channel 53*a* and the collecting channel 54*a* of the new-developing device.

The developing device includes a supply opening linking the developing roller 50 and inner of the supply channel 53*a*, a collecting opening linking the developing roller and inner of the collecting channel 54*b*, and a cover sheet 70 covering the supply channel 53*a* and the collecting channel 54*b*.

The developing device includes a sheet collecting shaft 703 to which an end of the cover sheet is fixed, and a cover sheet storing part 705 that include the sheet collecting shaft inside. Before image forming process, the sheet collecting shaft 703 wind the cover sheet 70 with rotating. Then the cover sheet 70 is removed from the supply opening 53*b* and the collecting channel 54*b*, and is collected to the cover sheet storing part 705. After the cover sheet is collected, the developer stored the supply channel 53*b* and the collecting channel 54*b* is released to the developing roller to ready to develop.

Referring to FIG. 1A, a sponge seal member 706 is disposed at the boundary part between the collecting channel 54*a* and the cover sheet storing part 705. The cover sheet 70 through the boundary. The sponge is sealing the gap of the boundary part. The developer in the collecting channel 54*a* is prevented to enter to the cover sheet storing part 705, by the sponge seal member 706

Referring to FIG. 1B, a winding drive force input gear 710 is disposed at the end part of the sheet collecting shaft 703. A shaft holder 704 prevent the sheet collecting shaft 703 from moving away from correct position.

When the developing device drive, a driving power is input to a developing driving member. The sheet collecting shaft is rotated by the driving power from the collecting screw gear serving as the developing driving member. Then the sheet collecting shaft 703 collect the cover sheet 70 to the cover sheet storing part.

The arrows A through D in FIG. 1 describe rotating direction of the developing sleeve 51, the supply screw 53, collecting screw, and the sheet collecting shaft 703, when the driving power is inputted to the developing device 51.

Figure 7A:
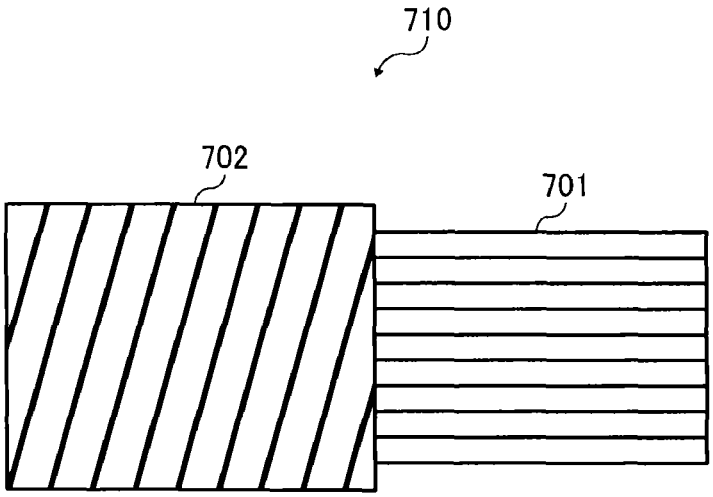
FIG. 7A is an enlarged side view of one embodiment of the winding force input gear.

FIG. 7A is expansion side view of the winding force input gear 710. The winding force input gear 710 is two-stage gear. A first stage of the winding force input gear 710 is an rotation force input gear 701 includes a spur gear inputted the force from the gear of the collecting screw 54.

Figure 7B:
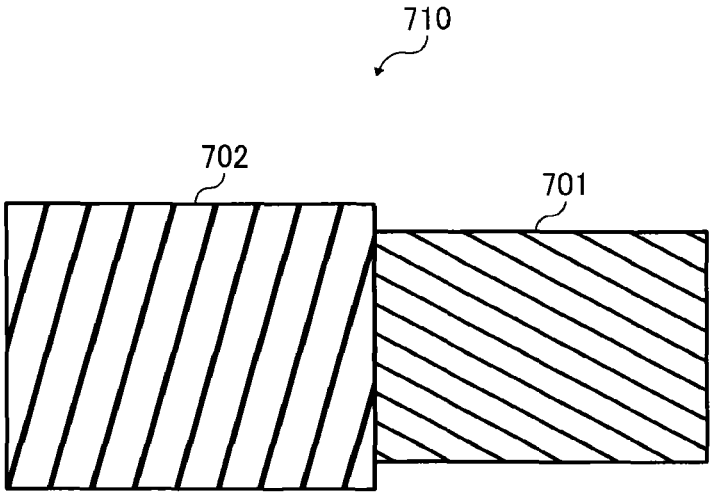
FIG. 7B is an enlarged side view of another embodiment of the winding force input gear.

A second stage of the winding force input gear 710 is thrust input gear 702 includes worm. And the thrust input gear is rotating with the input gear 710. It is possible to use a helical gear as the rotation force input gear 701 (see FIG. 7B). The worm used for the thrust input gear 702 is a screw gear which can be composed the worm gear by combing with a worm wheel. The winding force input gear 710 is fixed to direction of the perpendicular to the axis of the sheet collecting shaft 703. However the winding force input gear 710 can move to direction of parallel to the axis of the sheet collecting shaft 703 (thrust direction).

Figure 5:
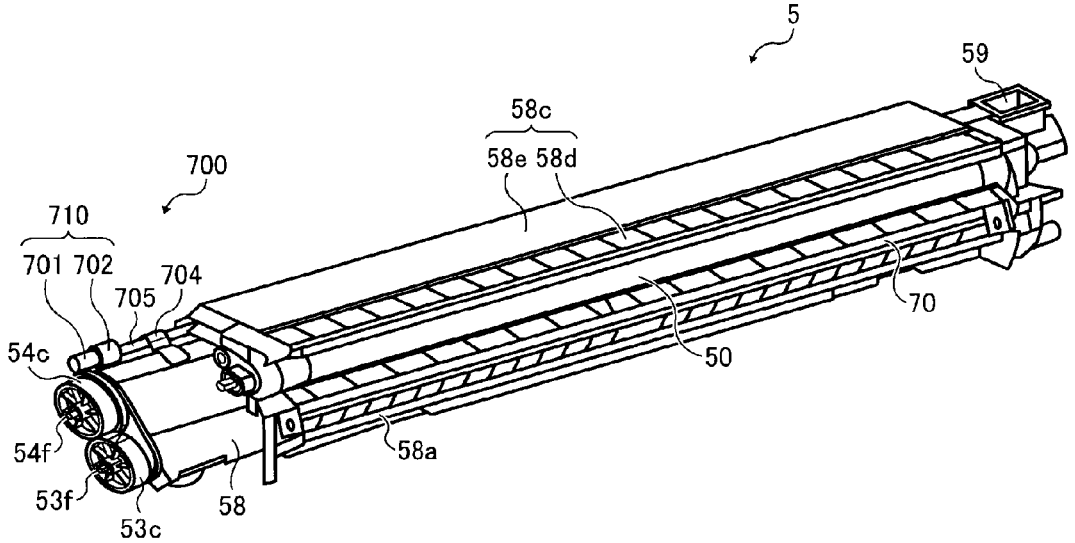
FIG. 5 is a perspective view of the developing device.

Referring FIG. 5, the near side end of the supply screw 53*f* protrudes from the near side end face of the casing 58 of the developing device 5.

A supply screw output gear 53*c* is at the near side end of a supply screw shaft 53*f*.

A near side end of a collecting screw shaft 54*f* which is shaft of the collecting screw 54 protrudes from the near ide end face of the casing 58. A collecting screw input gear 54*c* at the near side end of a collecting screw shaft 54*f*. The collecting screw input gear 54*c* and the supply screw output gear 53*c* is meshing.

Referring to FIG. 1B, a collecting screw output gear 54*d* is on the collecting screw shaft. A diameter of the collecting screw output gear is larger than the collecting screw input gear 54*c*. In this embodiment, the collecting screw input gear 54*c* and the collecting screw output gear 54*d* is integrally formed two-stage gear. Before the cover sheet is wound up, the collecting output gear 54*d* and the rotation force input gear 701 is meshing.

When the developing device 5 is installed to image forming apparatus 500, the force to rotate is inputted there into. The force to rotate is communicated to the developing sleeve 51 and the supply screw 53. Then the developing sleeve 51 and the supply screw 53 rotate to a counterclockwise direction as an arrow B in FIG. 1A. When the supply screw rotates, the supply screw output gear 53*c* fixed at the supply screw shaft rotates, and the collecting screw input gear meshed the supply screw output gear rotates. Since the collecting screw input gear 54*c* rotates, the collecting screw rotates to a clockwise direction as arrow C in FIG. 1A, and the collecting screw output gear 54*d* rotates. When the collecting screw output gear 54*d* rotates, a winding force input gear 710 with the input gear 700 which is meshed with the collecting screw output gear 54*d*, and the sheet collecting shaft 703, fixed to direction of the perpendicular to the axis of the sheet collecting shaft 703, rotates.

Figure 8:
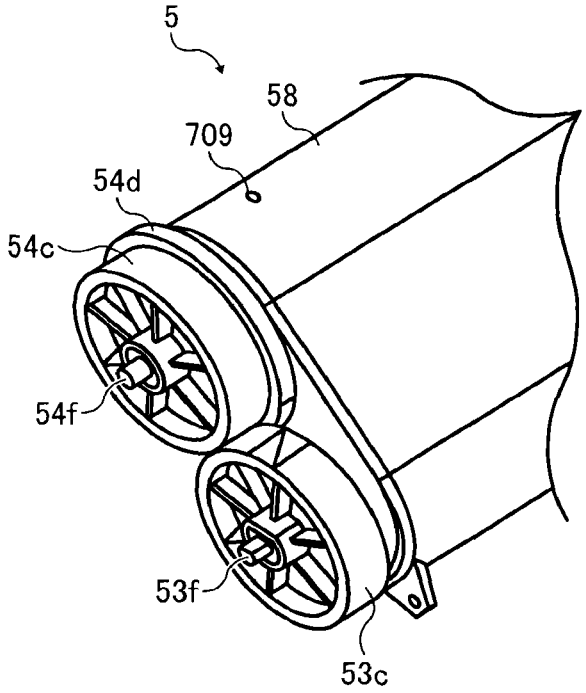
FIG. 8 is an enlarged perspective view of a protrusion of the casing.
Figure 9:
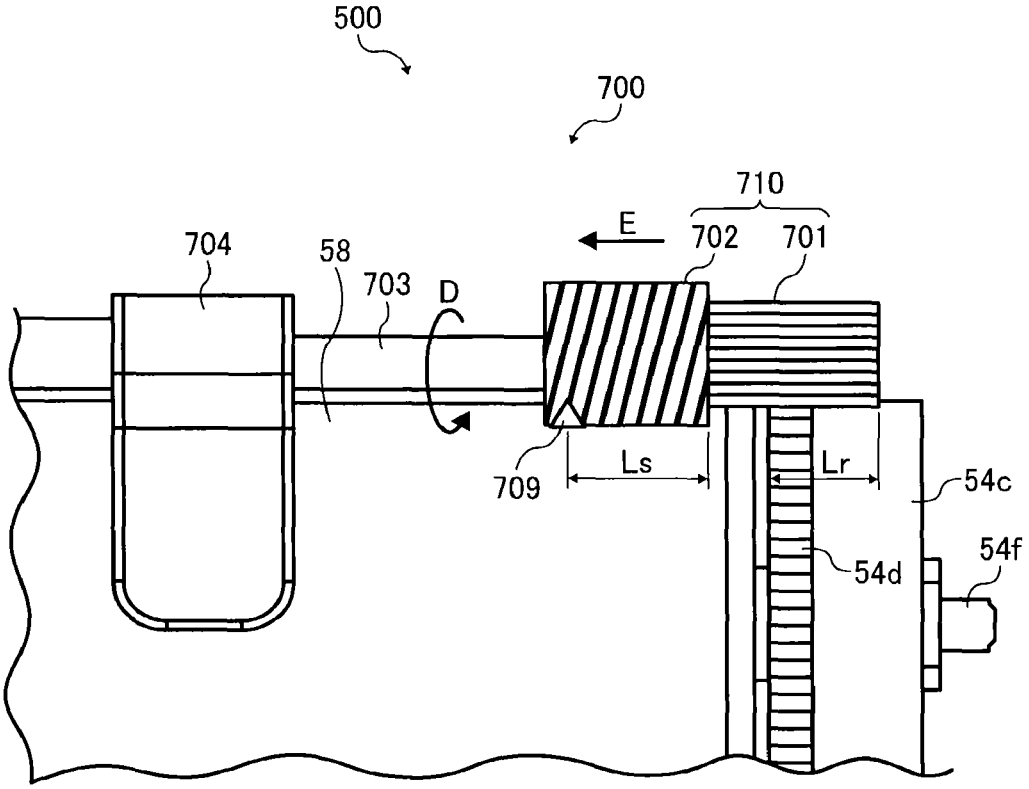
FIG. 9 is view of a drive communication shutdown system.

As shown in FIG. 1B, the casing of the developing device has a case protrusion 709 protruding from the surface of the casing 58, so that the case protrusion 709 meshes with a groove of the thrust input gear 702. FIG. 8 is an enlarged perspective view around the case protrusion 709. FIG. 9 is a side view of a drive communication shutdown system 700, and describe a positional relation of the thrust input gear 702 and the case protrusion 709.

Referring to FIG. 9, before the developing device 5 is used, the case protrusion 709 meshes with the groove of the thrust input gear 702 at a position which has a distance (Ls; described in FIG. 9) from the near side end of the thrust input gear 702. The winding force input gear is not fixed to the sheet collecting shaft 703. However the winding force input gear is not able to move to thrust direction, because the case protrusion 709 contacts a thread of the thrust input gear 702. The winding force input gear 710 is prevented from moving to the thrust direction before the force to rotate is inputted.

When the driving force is inputted from the image forming apparatus 500 to the developing device 5, the sheet collecting shaft 703 rotates to the direction of arrow D in FIG. 9, with the winding force input gear 710. The case protrusion 709 is engaged with the groove of the thrust input gear 702. When the thrust input gear 702 rotates to direction of arrow E in FIG. 9, a force toward the thrust direction as arrow E in FIG. 9, is acting to the thrust input gear 702. And then the winding force input gear 710 including the thrust input gear 702, moves to the direction of arrow D in FIG. 9.

When the winding force input gear 710 moves to the thrust direction, a position of the rotation force input gear 701 relative to axis direction of the collecting screw output gear changes, and the rotation force input gear 701 is released from the collecting input gear 54*d*. When the each gear is released, the communication of rotating force is cut and winding operation by the sheet collecting shaft is stopped. Thus in the developing device 5 of the embodiment, the drive communication shutdown system 700 is compounded by the winding force input gear 710 includes rotation force input gear 701 and the thrust input gear 702, and the case protrusion 709.

In the embodiment described in FIG. 9, thrust movement distance (LS) is longer than a length of a thrust direction length of the input gear (Lr). The thrust movement distance (LS) is a length from a contact point (engage point), where the case protrusion 709 contacts the thrust input gear 702 before the force is inputted, to an end part of the opposite side (right hand side in FIG. 9) of the movement direction by rotating of the thrust input gear. A length of a thrust direction length of the input gear (Lr) is a length from a contact point, where an end part of the movement direction (left hand side in FIG. 9) of the collecting screw output gear contacts the rotation force input gear 701, to an end part of the movement direction by rotating of the collecting output gear.

Since the thrust movement distance (LS) is longer than a length of a thrust direction length of the input gear (Lr), the winding force input gear 710 moves to thrust direction (left hand side in FIG. 9) by rotational inertia of the itself, after the rotation force input gear 701 is released from the collecting screw output gear 54*d*. After the rotation by the inertia is stopped, the winding force input gear 710 is not able to move to thrust direction (right hand side in FIG. 9), because the case protrusion 709 contacts the thread of the thrust input gear 702. Therefore, the re-contacting of the collecting screw output gear 54*d* and rotation force input gear 701 is prevented.

A real loft angle is 15 degrees or more, and at the time of defining a club length as L (inches), head volume as W (cc) and the real loft angle as R (degrees), the following expression (A) is satisfied At that time of defining the moving distance to the thrust direction of the thrust input gear 702 per one rotation as 'lead Pi', it is prefer to satisfy the following expression (1).

thrust movement distance (*LS*)−a length of a thrust direction length of the input gear (*Lr*)<'rotation number of the winding force input gear 710 by rotational inertia' multiply 'lead *Pi*' (1)

When the expression (1) is satisfied, the thrust input gear is released from the case protrusion after winding process, and the case protrusion acts as a stopper which prevent the winding force input gear 710 from moving to the thrust direction (right hand direction in FIG. 9). Therefore the re-contacting of the collecting screw output gear 54*d* and rotation force input gear 701 by the driving vibration of the image forming apparatus 500 is prevented more certainly.

Figure 10:
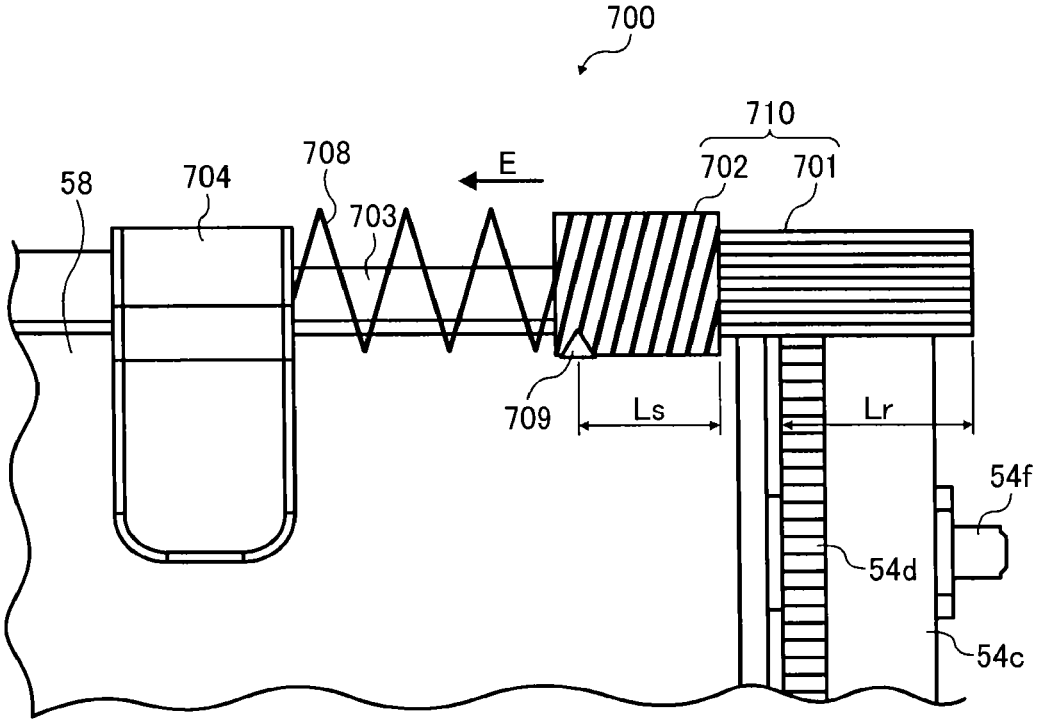
FIG. 10 is view of a drive communication shutdown system with spring.

FIG. 10 is side view of the other embodiment that the spring member 708 pulling the winding force input gear 710 toward the side of the moving thrust direction by a rotation, is added to the drive communication shutdown system 700. In FIG. 10, the winding force input gear 710 is pulled by the spring member 708 toward the left hand side of FIG. 10 even before the force is inputted. However the case protrusion 709 contacts with the thread of the thrust input gear 702 and the winding force input gear 710 does not move to the thrust direction.

When the driving force is inputted and the winding force input gear 710 moves to thrust direction (left hand side of FIG. 10), the thrust direction end part of the thrust input gear pass through the case protrusion 709. Then the winding force input gear 710 does not contact the case protrusion 709 and the winding force input gear 710 moves to the thrust direction (left side of FIG. 10) by pulling force of the spring member.

As shown in FIG. 10, the thrust movement distance (LS) may be shorter than a length of a thrust direction length of the input gear (Lr), if a support of the moving of the thrust direction by the spring member 708 is added as shown in FIG. 10.

In this embodiment, after the thrust input gear 702 is released from the case protrusion, the rotation force input gear 701 is released from the collecting screw output gear, and the winding operation of the cover sheet is stopped.

If the force of the thrust direction by the spring member is added, the malfunction caused by the supporting of the spring member 708 is not occurred because of characteristics of the worm of the thrust input gear.

At that time of defining the winding amount needed to remove the cover sheet as winding amount (M), a diameter of the winding point of the sheet collecting shaft 703 as winding diameter (D) and the circular constant as 'π'. It is preferable to satisfy the following expression (2).

thrust movement distance (*LS*)/'lead *Pi*'≥winding amount (*M*)/(winding diameter (*D*)×π) (2)

When the expression (2) is satisfied, the winding operation of the cover sheet 70 is stopped, after the cover sheet 70 is completely winded.

Figure 11:
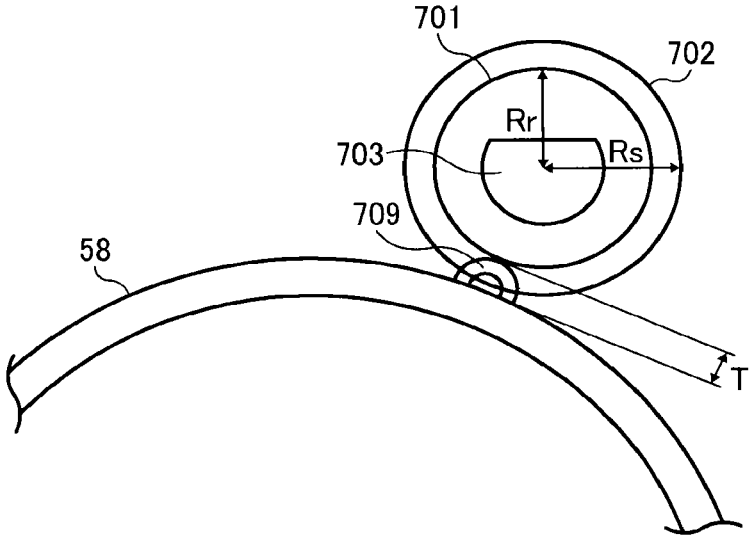
FIG. 11 is a view indicating a relation between a difference between a diameter of a thrust input gear and an rotating force input gear, and an amount of a bite of the case protrusion to the thrust input gear.

FIG. 11 is a view indicating a relation between the difference between the diameter of the thrust input gear 702 and the rotation force input gear 701, and an amount of the bite of the case protrusion 709 to the thrust input gear 702.

As shown in FIG. 9 and FIG. 10, a moving direction of the thrust input gear by rotating itself is direction where rotation force input gear 701 faces thrust input gear 702 side. In this embodiment, at that time of defining a radius of a tooth tip circle of the thrust gear 702 as thrust input gear radius (Rs), the amount of the bite of the case protrusion 709 to the thrust input gear 702 as protruding biting amount (T) and a tooth tip circle of the rotation force input gear 701 as input gear radius (Rr). It is prefer to satisfy the following expression (3).

thrust input gear radius (*Rs*)−protruding biting amount (*T*)>input gear radius (*Rr*) (3)

When the expression (3) is satisfied, it is prevented that the rotation force input gear 701 moved to thrust direction contacts the case protrusion 709. And the winding operation of the cover sheet 70 is stopped certainly.

Figure 12A:
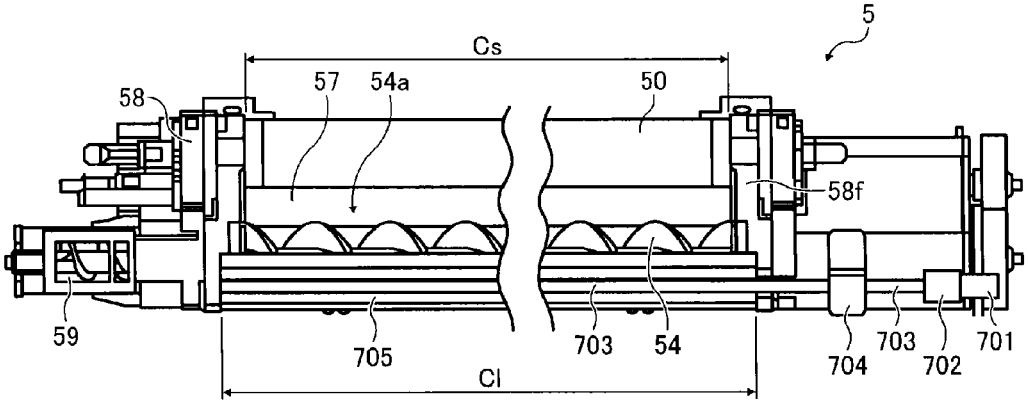
FIG. 12A is a top view of the developing device without the development cover and without the cover sheet.
Figure 12B:
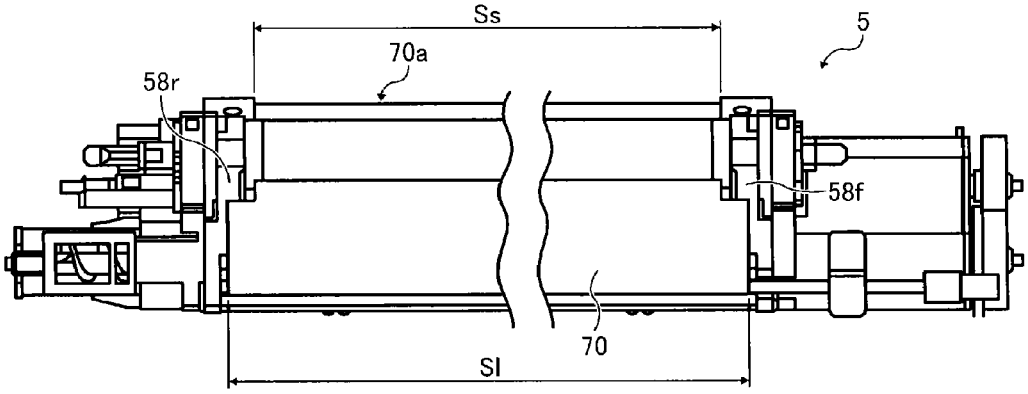
FIG. 12B is a top view of the developing device without the development cover and with the cover sheet.

FIGS. 12A and 12B are top views of the developing device 5 without the development cover 58*c* as upper cover. It is a view indicating relation between the length of the axis direction of the cover sheet 70 and the casing 58 of the developing device 5. FIG. 12A is view of the developing device without the cover sheet 70. FIG. 12B is view of the developing device 5 with the cover sheet.

As shown in FIGS. 12A and 12B, among the two side plates that form short side part of the both sides of the casing 58, the one that is disposed at right side of the FIG. 12 (the front side of the FIG. 1A) is a front side plate 58*f*, and another side one that is disposed at left side of the FIG. 12 (the rear side of the FIG. 1B) is a rear side plate 58*r*.

A length of a place where the cover sheet cover the supply opening 53*b* and the collecting opening 54*b*, in other words, between an inner wall of the front side plate 58*f* and rear side plate 58*r* that is disposed along the surface of the developing roller 50, of an axis direction is defined a first casing distance Cs.

Figure 13:
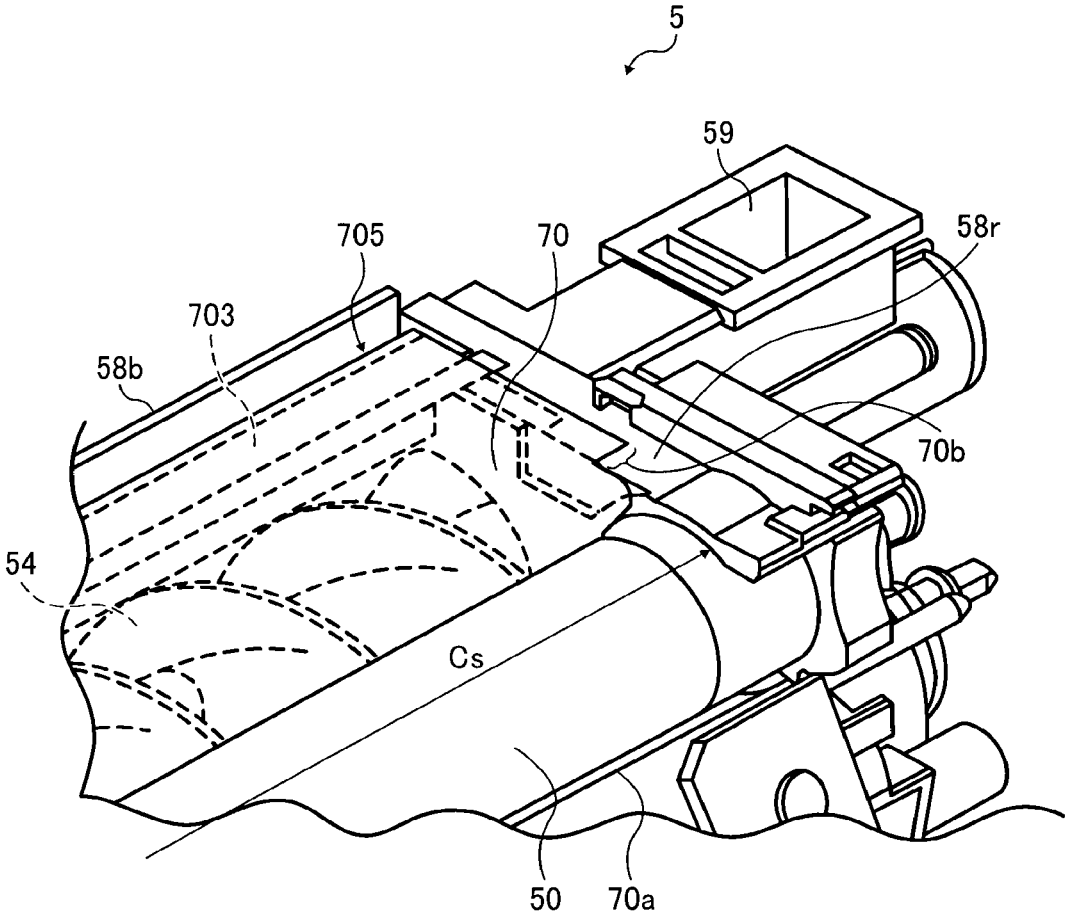
FIG. 13 is enlarged perspective view of near a rear side of the developing device.

FIG. 13 is enlarged perspective view of near the rear side plate 58*r* of the developing device shown FIG. 12B. In FIG. 13, a part hidden by the cover sheet 70 is described by a broken line. FIG. 13 describes the part where the axial distance between inner wall of the front side plate 58*f* and the rear side part 58*r* is the first casing distance Cs is being illustrated.

The cover sheet is inserted at the part where the axial distance between inner wall of the front side plate 58*f* and the rear side part 58*r* is a first casing distance Cs. Therefore a developer leaking to the developing roller 50 from the supply channel 53*a* and the collecting channel 54*a* is prevented. In such a case, preferably, the cover sheet 70 covers the whole the developing roller 50 surface that faces the supply channel 53*a* and the collecting channel 54*a* as shown in FIG. 1A.

The axis direction distance between the inner wall of the front side plate 58*f* and the rear side plate 58*r* at the cover sheet storing part 705 in where the sheet collecting shaft 703 is disposed, is defined as a second casing distance Cl. A width of the cover sheet 70 of a part that covers the supply opening 53*b* and collecting opening 54*b* (including lower end 70*a*) before the winding operation starts, is defined as a cover sheet width Ss.

A width of the cover sheet of a part including a part fixed to the sheet collecting shaft before the winding operation starts, is defined as a sheet root width Sl.

And the developing device 5 is set to be satisfied a following expression.

$$Cl \geq Sl > Cs \geq Ss \quad (4)$$

Since the cover sheet width Ss is set so as to be shorter than the first casing distance Cs, the cover sheet can be disposed along the surface of the developing roller 50. The sheet root width Sl is set so as to be larger than the first casing distance Cs, and the end part of the axis direction of the cover sheet 70 is sandwiched by the upper surfaces of the front side plate 58*f* and the rear side plate 58*r*, and lower surface of the development cover 58*c*.

At the upper surfaces of the front side plate 58*f* and the rear side plate 58*r*, a step part is disposed between the inner surfaces forming the first casing distance Cs and an inner surface forming the second casing distance Cl.

As shown in FIG. 12B and FIG. 13, a broad end part of the sheet 70*b* where the more outside part than the cover sheet width Ss in the axis direction at the sheet root width Sl of the cover sheet 70, is disposed at the step part.

The broad end part of the sheet 70*b* is sandwiched between the step parts at the front side plate 58*f* and rear side plate 58*f*, and an end part of an axial direction of the development cover 58*c* reserved as axis direction casing that forms a part of the wall of the collecting channel 54*a* and elongated to the axis direction.

In the above embodiment, the broad end part of the sheet 70*b* is sandwiched between the upper surfaces of the front side plate 58*f* and rear side plate 58*r*, and the lower surface of the development cover 58*c*. The cover sheet is kept in a state as shown in FIG. 1A.

The cover sheet can be disposed along the lower part of the development cover 58*c* that is a ceiling of the collecting channel 54*a*, and the surface of the developing roller 50.

As the cover sheet 70 is disposed along the lower surface of the development cover 58*c* by near the developing roller 50, forming a gap between the lower surface of the developing cover 58*c* and the upper surface of the cover sheet 70 is prevented.

In this embodiment forming a gap between the lower surface of the developing cover 58*c* and the upper surface of the cover sheet 70 is prevented. And the developer passed through the gap of the end part of the axis direction of the cover sheet prevented from moving to the next gap.

Therefore, if the developer enters the gap of the end part of the axis direction of the cover sheet, it is clogged at the gap. The new developer is prevented from entering the gap. Remaining the developer at the gap between the cover sheet 70 and the development cover 58*c* is prevented. And forming the agglomerate and an abnormal image caused by the agglomerate is prevented.

The second casing distance Cl is set so as to be wider than the sheet root width Sl and the first casing direction Cs as shown the expression (4). Since the setting, a part of the cover sheet where it is wider than the first casing distance Cs, is collecting easily.

Figure 14A:
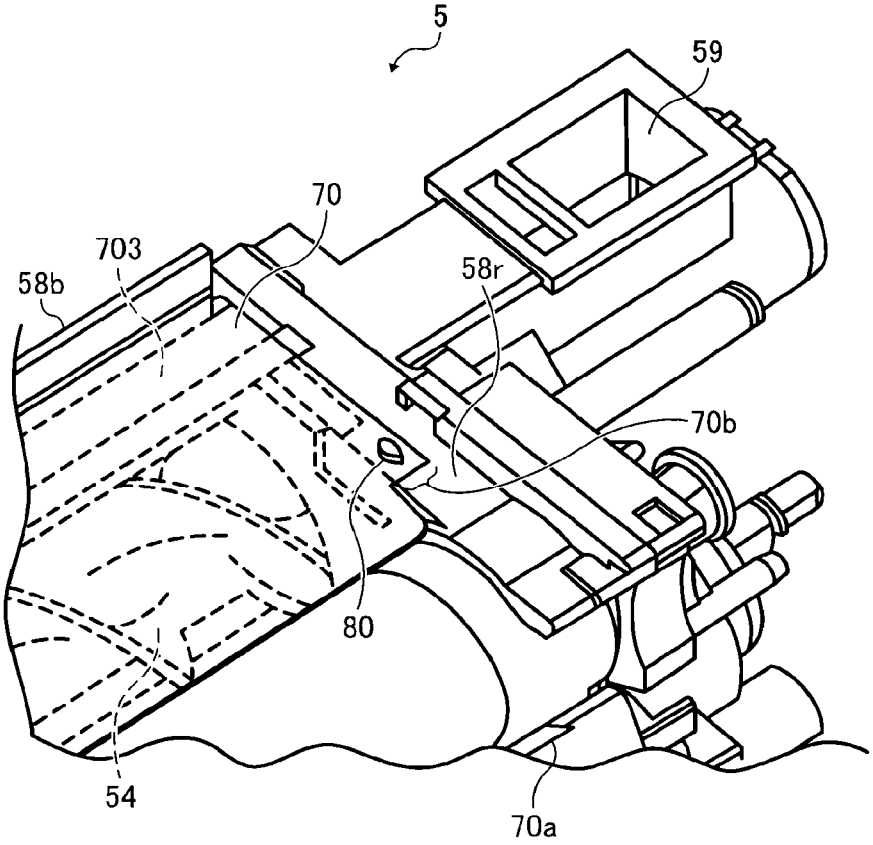
FIG. 14A is an enlarged perspective view of the developing device added a sheet set boss.
Figure 14B:
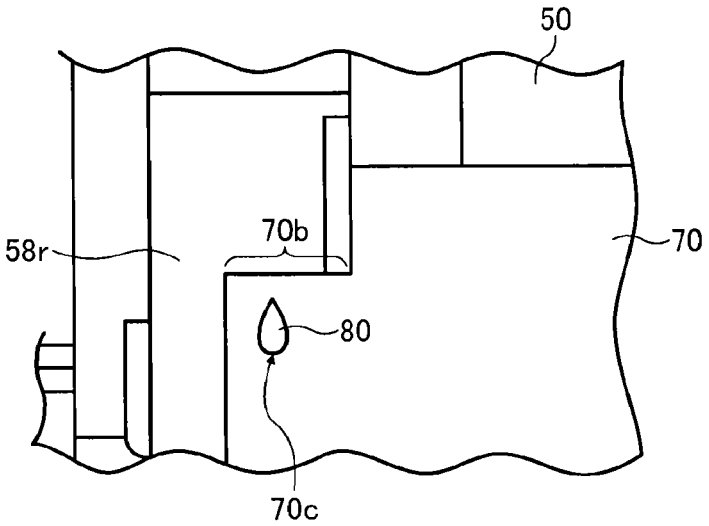
FIG. 14B is an enlarged upper view of the developing device added a sheet set boss.

FIGS. 14A and 14B are views of the developing device 5 added a sheet set boss 80 at the upper surfaces of the front side plate 58*f* and the rear side plate 58*r*. FIG. 14A is an enlarged perspective view of the near the rear side plate with a sheet set boss 80. FIG. 14B is an enlarged upper view of the near the rear side plate with the sheet set boss 80. The sheet set boss 80 is a protrusion.

In the developing device shown in the FIG. 14B, a boss opening 70*c* (a protrusion opening) penetrated by the sheet set boss 80 is disposed at the broad end part of the sheet 70*b*.

In the developing device 5 shown in FIGS. 14A and 14B, since the sheet set boss disposed at the casing 58 is penetrated the boss opening 70*c*, the cover sheet is positioned and an assembling efficiency can be improved.

Even if a vibration is transmitted to the developing device 5 when it is transported, the cover sheet can keep the position as shown FIG. 1A.

In this embodiment, the sheet set boss 80 is disposed at the upper surface of the front side plate 58*f* and rear side plate 58*r*. However, a protrusion like the sheet set boss may be disposed at the lower surface of the development cover 58*c*.

In FIG. 14B, the cover sheet moves toward the under direction of FIG. 14B, when the cover sheet is winded. An angle of an acute angle is disposed at an upper stream (upper direction of FIG. 14B) of the moving direction of the coversheet moved to the under direction of FIG. 14B, of the sheet set boss 80.

This angle cuts the cover sheet 70. When the cover sheet 70 is winded, an upstream of the boss opening 70*c* part of the moving direction of the broad end part of the sheet 70*b*, is prevented from remaining and is cut easily.

Therefore, a shape to hook the part of the cover sheet 70 to the sheet set boss, does not prevent the winding operation.

The upstream of the boss opening 70*c* part (upper side of FIG. 14A) of the moving direction of the cover sheet 70, may have a slit or an assisting part to assist cutting.

In the above embodiment, when the cover sheet moves to the direction of the winded by the sheet collecting shaft 703, the edge of the boss opening 70*c* contacted to the sheet set boss 80 is cut easily.

And, when the cover sheet 70 is winded, a frictional resistance between the cover sheet 70 and the sheet set boss 80 is restrained. A malfunction (i.e., the developing device is broken by shock) is prevented, when the cover sheet is stocked.

For example, assist processing to assist cutting is MAGIC CUT (Trade Mark).

As shown in FIG. 14B, in a moving direction of the cover sheet, a shape of a downstream part (below side of FIG. 14B) of the sheet set boss 80 is formed as curved shape. In this case, the cover sheet part that contacts the curved part, is prevented from cutting. And the cover sheet 70 is prevented from passing through to opposite side (upper side of FIG. 14B)

As shown in FIG. 1A, the developing device 5 has a vent opening 580 that communicates the outside and collecting channel 54*a* and air can pass through the vent opening 580. Furthermore the developing device 5 has a cover filter 523 preventing from passing the developer through the vent opening 580. In this embodiment, the vent opening prevents an increasing pressure of the developing device 5. The cover filter 523 prevents toner leaking from developing device 5 through the vent opening 580.

The cover sheet 70 shuts between the developer in the collecting channel 54*a* and the cover filter 523, before the winding operation starts as shown in FIG. 1A. Therefore before the developing device 5 is used, the developer is prevented to contact the cover filter 523. A clogging of the cover filter 523 is prevented, and the service life of the cover filter 523 will be prolonged.

The winding operation is proceeded, before starting an initial process when the developing device is mounted to the image forming apparatus. Therefore a process that the serviceman or user pulls the cover sheet 70 is not needed, and a time of initial install process will be short.

Since the winding operation is automatic, malfunction by forgetting to remove the cover sheet is prevented, and usability is improved.

The sheet collecting shaft 703 winds the cover sheet 70 and moves the cover sheet 70 to a perpendicular direction of the rotation axis of the developing roller.

In this embodiment, the developing device is able to shut the developer to developing roller 50, and to wind the cover sheet 70 automatically. To dispose the cover sheet 70 is simple, so the cover sheet is prevented from breaking.

The system, that after the cover sheet 70 is removed, in which transmitting force to the sheet collecting shaft is stopped, can be applied to a system that the cover sheet moves to a direction of parallel to the rotation axis by the winding operate.

In this embodiment, the developing device 5 is a one way circulation developing device, and a plurality of developer convey channels are connected via openings, the openings are covered by a cover sheet 70.

The system winding the cover sheet automatically and stopping transmit of the rotation force to the sheet collecting shaft 703 after the cover sheet is removed, is not limited to the system from which a plurality of openings are covered by a cover sheet.

For example, the system described in patent of JP 4341957 can use the system winding the cover sheet automatically and stopping transmit of the rotation force to the sheet collecting shaft after the cover sheet is removed.

The system winding the cover sheet automatically and stopping transmit of the rotation force to the sheet collecting shaft after the cover sheet is removed can be used for the system the cover sheet is fixed to the casing, for example a system described in patent JP 4341957.

What is claimed is:

1. A developing device comprising:

a developer bearer to carry developer to a developer range where the developer bearer faces a latent image bearer;

a development casing forming a developer storing part storing the developer to supply to a surface of developer bearer;

a developer through opening communicating a space in where the developer bearer is disposed and the developer storing part;

a cover sheet covering the developer through opening at the developing casing, and when the cover sheet is removed, the developer passing through the developer through opening;

a sheet collecting shaft to collect the cover sheet by rotating; and a transmitting mechanism to transmit a force for rotating to the sheet collecting shaft, wherein the transmitting mechanism does not transmit the force for rotating to the sheet collecting shaft after the cover sheet is collected, wherein the transmitting mechanism includes first and second gears, wherein when the first and second gears are engaging, the force for rotating to the sheet collecting shaft is transmitted, and wherein when the first and second gears are no engaging, the force for rotating to the sheet collecting shaft is not transmitted.

2. The developing device according to claimed 1,wherein the transmitting mechanism includes:

a transmitting shaft to transmit the force to the sheet collecting shaft;

the first gear which is a force output member to output the force inputted to a developing driving member when a developing process starts;

the second gear which is a force input member at the transmitting shaft, transmitting the force from the transmitting shaft, when the transmitting shaft engages the force input member when rotating, and to move an axis direction of the transmitting shaft;

a drive communication engagement release mechanism to move the force input member to the axis direction of the transmitting shaft with the transmitting shaft rotating, and to release the engagement between the force input member and the force output member.

3. The developing device according to claim 2, wherein the force input member is a rotation force input gear, and the force output member is a rotation force output gear, and the rotating force input and output gears are both a spur gear or a helical gear, and wherein the drive communication engagement release mechanism includes:

a thrust input gear includes a worm fixed at the rotation force input gear, and rotating and moving to the axis direction of the transmitting shaft with the rotating of the rotation force input gear rotation, and an engaging member fixed the development casing and engaging the thrust input gear, and producing a moving force to move the thrust gear to the axis direction of the rotation force input gear with rotating.

4. The developing device according to claim 3, further comprising:

an energizing member energizing the thrust input gear fixed at the rotation force input gear, to an axis direction to which the thrust input gear moves with rotating.

5. The developing device according to claim 3, wherein when a distance from an engaging point of the thrust input gear where the thrust input gear engages the engaging member before the driving force is inputted, to an end of the thrust input gear of the opposite side of moving direction by rotating is thrust moving direction Ls, a distance from an engaging point of the input gear where the rotation force input gear engages an end of the rotation force output gear of the opposite side of the moving direction of the rotation force input gear by rotating is Lr, the distance Ls and Lr satisfy the following relationship:

$$Ls>Lr.$$

6. The developing device according to claim 4, wherein when a distance from an engaging point of the thrust input gear where the thrust input gear engages the engaging member before the driving force is inputted, to an end of the thrust input gear of the opposite side of moving direction by rotating is thrust moving direction Ls, a distance from an engaging point of the input gear where the rotation force input gear engages an end of the rotation force output gear of the opposite side of the moving direction of the rotation force input gear by rotating is Lr, the distance Ls and Lr satisfy the following relationship:

$$Ls<Lr.$$

7. The developing device according to claim 3, wherein when the direction of the moving direction of the thrust input gear by rotating is a direction which the rotation force input gear moves toward the thrust input gear, a radius of a tooth tip circle of the thrust gear is Rs, an amount of a bite of a case protrusion to the thrust input gear is T, and a tooth tip circle of the rotation force input gear is Rr, the radius Rs, the amount T, and the tooth tip circle Rr satisfy the following relationship:

$$Rs-T>Rr.$$

8. The developing device according to claim 3, wherein when a distance from an engaging point of the thrust input gear where the thrust input gear engages the engaging member before the driving force is inputted, to an end of the thrust input gear of the opposite side of moving direction by rotating is thrust moving direction Ls, a lead of the thrust input gear is Pi, a winding amount needed to remove the cover sheet is M a diameter of the winding point of the sheet collecting shaft is D, and a circular constant is π, the distance Ls, the lead Pi, the winding amount M, the diameter D, and circular constant π satisfy the following relationship:

$$Ls/Pi>M/(D\cdot\pi).$$

9. The developing device according to claim 1, wherein the sheet collecting shaft winds the cover sheet while the cover sheet moves to the direction of perpendicular to a rotating axis of the developer bearer.

10. The developing device according to claim 9, wherein when a distance between a development casing inner wall in axial direction of both ends parallel to the rotating axis where the cover sheet covers the developer through opening is a first casing distance Cs, a distance between the development casing inner wall in axial direction of both ends parallel to the rotating axis where the sheet collecting shaft is disposed is a second casing distance Cl, a width of the cover sheet of a part that covers the developer through opening before the winding operation starts is a cover sheet width Ss, a width of the cover sheet of a part fixed to the sheet collecting shaft before the winding operation starts is a root sheet width Sl, the first casing distance Cs, the second casing distance Cl, the cover sheet width Ss, and the root sheet width Sl, satisfy the following relationship:

$$Cl \geq Sl \geq CsSs, \text{ and}$$

wherein a broad end part of the sheet where the more outside part than the cover sheet width Ss in the axis direction at the sheet root width Sl of the cover sheet, is disposed at a step part disposed between the inner surfaces forming the first casing distance Cs and an inner surface forming the second casing distance Cl, and the broad end part of the sheet is sandwiched between the step parts and an end part of an axial direction of an axis direction casing that forms a part of the wall of the developer storing part and elongated to the axis direction.

11. The developing device according to claim 10, further comprising:

a protrusion disposed in at least an end part in an axis direction of the axis casing or the step part, and the protrusion protrudes to the other hand, and the broad end part include a protrusion opening penetrated by the protrusion.

12. The developing device according to claim 11, wherein the cover sheet includes a slit or an assisting part to cut an edge of the protrusion opening contacted the protrusion , when the cover sheet moves to the direction of the winding by the sheet collecting shaft.

13. The developing device according to claim 11, wherein the protrusion includes an angle of an acute angle disposed at an upper stream part of the moving direction of the coversheet winding by the collecting shaft.

14. The developing device according to claim 11, wherein the protrusion includes a curved shape portion disposed at a downstream part of the protrusion in a moving direction of the cover sheet winding.

15. The developing device according to claim 11, further comprising:

a vent opening disposed at the development casing, and connecting the developing storing part and the outside; and a filter to prevent to pass the developer through the vent opening, wherein the cover sheet covers between the developer in the developing storing part and the filter, before winding operation starts.

16. The developing device according to claim 1, wherein the developer includes toner and carrier, the developer storing part is separated by a partition into a supply channel to supply the developer to the developer bearer and to convey the developer to an axis direction of the developer bearer, and a collecting channel to collect the developer passed a developing area from the developing bearer and to convey the developer to an axis direction of the developer bearer, the developer reached to the downstream of the supply channel moves to the collecting channel, and the developer reached to the downstream of the collecting channel moves to the supply channel, and the developer through opening includes a supply opening linking the developer bearer and inside of the supply channel, and a collecting opening linking the developer bearer and inside of the collecting channel.

17. An image forming apparatus comprising:

the latent image bearer;

a charging member to charge a surface of the latent image bearer; and the developing device according to claim 1.

18. A process cartridge removably installed in an image forming apparatus, the process cartridge comprising at least the latent image bearer;

the developing device according to claim 1; and a common unit casing to hold at least the latent image bearer and the developing device as a single unit.

* * * * *